US009204726B2

(12) United States Patent
Tseng

(10) Patent No.: US 9,204,726 B2
(45) Date of Patent: Dec. 8, 2015

(54) FOLDABLE CHAIR

(71) Applicant: CHIN JWU ENTERPRISE CO., LTD., Chiayi Hsien (TW)

(72) Inventor: Chun-Hsien Tseng, Chiayi Hsien (TW)

(73) Assignee: CHIN JWU ENTERPRISE CO., LTD., Chiayi Hsien (TW)

( * ) Notice: Subject to any disclaimer, the term of this patent is extended or adjusted under 35 U.S.C. 154(b) by 74 days.

(21) Appl. No.: 13/902,047

(22) Filed: May 24, 2013

(65) Prior Publication Data

US 2014/0346817 A1 Nov. 27, 2014

(51) Int. Cl.

| | |
|---|---|
| ***A47C 4/00*** | (2006.01) |
| ***A47C 4/44*** | (2006.01) |
| ***A47C 4/10*** | (2006.01) |
| ***A47C 4/34*** | (2006.01) |
| ***A47C 4/42*** | (2006.01) |
| *A47B 3/08* | (2006.01) |

(52) U.S. Cl.

CPC ..... *A47C 4/44* (2013.01); *A47B 3/0809* (2013.01); *A47B 3/0812* (2013.01); *A47B 3/0818* (2013.01); *A47C 4/10* (2013.01); *A47C 4/34* (2013.01); *A47C 4/42* (2013.01); *A47B 3/08* (2013.01); *A47B 2003/0827* (2013.01)

(58) Field of Classification Search

USPC ..... 297/452.63; 403/378, 379.5, 109.2, 403/109.6, 109.8

See application file for complete search history.

(56) References Cited

U.S. PATENT DOCUMENTS

| | | | | | |
|---|---|---|---|---|---|
| 973,406 | A * | 10/1910 | Clark | 135/25.4 |
| 1,061,935 | A * | 5/1913 | Collier | 297/37 |
| 1,992,434 | A * | 2/1935 | Kosanek | 297/140 |
| 2,156,664 | A * | 5/1939 | Litle, Jr. | 5/190 |
| 2,508,607 | A * | 5/1950 | Hill | 297/37 |
| 2,995,182 | A * | 8/1961 | Hendrickson | 297/451.3 |
| 3,046,005 | A * | 7/1962 | Raduns | 267/110 |
| 3,572,834 | A * | 3/1971 | Herzer et al. | 297/410 |
| 3,584,675 | A * | 6/1971 | Borichevsky | 160/371 |
| 4,545,614 | A * | 10/1985 | Abu-Isa et al. | 297/284.2 |
| 4,602,816 | A * | 7/1986 | Chandler | 296/63 |
| 4,801,176 | A * | 1/1989 | Wolberg | 297/44 |
| 5,733,010 | A * | 3/1998 | Lewis et al. | 297/411.32 |
| 6,050,643 | A * | 4/2000 | Kain | A47D 1/004 297/130 |
| 6,074,013 | A * | 6/2000 | Hsiao | 297/440.1 |
| 6,334,650 | B1 * | 1/2002 | Chien-Chuan | 297/284.1 |
| 2003/0209935 | A1 * | 11/2003 | Legal | 297/452.63 |
| 2004/0245810 | A1 * | 12/2004 | Tseng | 297/56 |
| 2004/0245839 | A1 * | 12/2004 | Bodnar et al. | 297/452.63 |
| 2004/0245841 | A1 * | 12/2004 | Peterson et al. | 297/452.63 |
| 2009/0302662 | A1 * | 12/2009 | Groelsma et al. | 297/452.18 |
| 2013/0092207 | A1 * | 4/2013 | Lovley et al. | 135/122 |
| 2013/0330118 | A1 * | 12/2013 | Van Dyne | 403/109.2 |

* cited by examiner

*Primary Examiner* — David E Allred

(74) *Attorney, Agent, or Firm* — Ladas & Parry LLP

(57) ABSTRACT

A foldable chair includes a seat frame unit, a leg frame unit, and a leg frame assembling unit. The leg frame unit includes two leg frames and is pivotable relative to the seat frame unit to change between an unfolded use state and a folded state. The leg frame assembling unit includes at least one resilient fastener and at least one pusher. The resilient fastener has a locking head to immobilize the one of the leg frames in the unfolded use state. The pusher has a protruding portion to push the locking head that is retracted inwardly from the seat frame unit, thereby releasing the one of the leg frames from the unfolded use state relative to the seat frame unit.

2 Claims, 9 Drawing Sheets

FOLDABLE CHAIR

BACKGROUND OF THE INVENTION

1. Field of the Invention

The invention relates to a chair, and more particularly to a foldable chair.

2. Description of the Related Art

Referring to FIGS. 1 and 2, a conventional foldable chair 1 is shown to include a seat frame 11 that has spaced-apart left and right seat frame rods 111, 112, a back frame 12 that is pivotally connected to a rear side of the seat frame 11, two pairs of pivot seats 13 that are connected to bottom sides of the left and right seat frame rods 111, 112, respectively, two spaced-apart left and right leg frames 14 that are pivotally connected to the two pairs of the pivot seats 13, respectively, and two pairs of resilient fasteners 15 that are respectively proximate to the two pairs of the pivot seats 13 and that are respectively disposed inside the left and right leg frames 14.

Each of the left and right leg frames 14 has two leg frame rods 141 that are spaced apart from each other in a front-rear direction and that are respectively inserted into and connected pivotally to the corresponding pair of the pivot seats 13 in the front-rear direction. As shown in FIG. 1, each of the leg frames 14 is pivotable relative to the seat frame 11 to change between an unfolded use state and a folded state.

Each of the resilient fasteners 15 includes an elastic strip 152 that is disposed inside a corresponding one of the leg frame rods 141, and a locking head 151 that is attached to an end of the elastic strip 152. The locking head 151 extends through locking holes 142, 131 that are respectively formed in the corresponding one of the leg frame rods 141 and the corresponding one of the pivot seats 13, thereby immobilizing the corresponding leg frame 14 in the unfolded use state.

As shown in FIG. 2, when the leg frames 14 are required to be in the folded state, the locking head 151 of each resilient fastener 15 disposed inside the corresponding one of the leg frame rods 141 is pressed in a direction of an arrow 16, such that the elastic strip 152 is forced to be deformed. Then, each of the resilient fasteners 15 retracts to a position as shown by phantom lines in FIG. 2. When the locking heads 151 are released from the pivot seats 13, the leg frames 14 are released from the unfolded use state relative to the seat frame 11 through disengagement between the resilient fasteners 15 and the pivot seats 13. Therefore, the leg frames 14 may be folded toward each other.

Even though the conventional foldable chair 1 is able to achieve its intended purpose through the abovementioned configuration, there are still some drawbacks in use. For example, in order to retract the locking heads 151 of the resilient fasteners 15, a user's finger has to extend into the locking hole 131 of the corresponding pivot seat 13 to push the locking head 151 to the position shown by the phantom lines in FIG. 2. As a result, the user's finger may be hurt by the locking hole 131 of the corresponding pivot seat 13. For example, a sharp edge of the corresponding locking hole 131 may cut the user's finger. In view of this, there is still a need for further improvement in the structure of the conventional foldable chair.

SUMMARY OF THE INVENTION

Therefore, an object of the present invention is to provide a foldable chair that can alleviate the aforesaid drawbacks of the prior art.

According to the present invention, a foldable chair comprises a seat frame unit, a leg frame unit, and a leg frame assembling unit.

The leg frame unit includes two spaced-apart leg frames respectively and pivotally connected to a bottom side of the seat frame unit. The leg frame unit is pivotable relative to the seat frame unit to change between an unfolded use state and a folded state.

The leg frame assembling unit is provided to assemble the leg frames on the seat frame unit, and includes at least one first resilient fastener that is disposed inside one of the leg frames, and at least one first pusher disposed on the seat frame unit proximate to the first resilient fastener. The first resilient fastener has a first locking head that extends through the one of the leg frames and the seat frame unit to immobilize the one of the leg frames in the unfolded use state. The first pusher has a first protruding portion aligned with the first locking head. The first pusher is pressable to enable the first protruding portion to push the first locking head such that the first locking head is retracted inwardly from the seat frame unit, thereby releasing the one of the leg frames from the unfolded use state relative to the seat frame unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
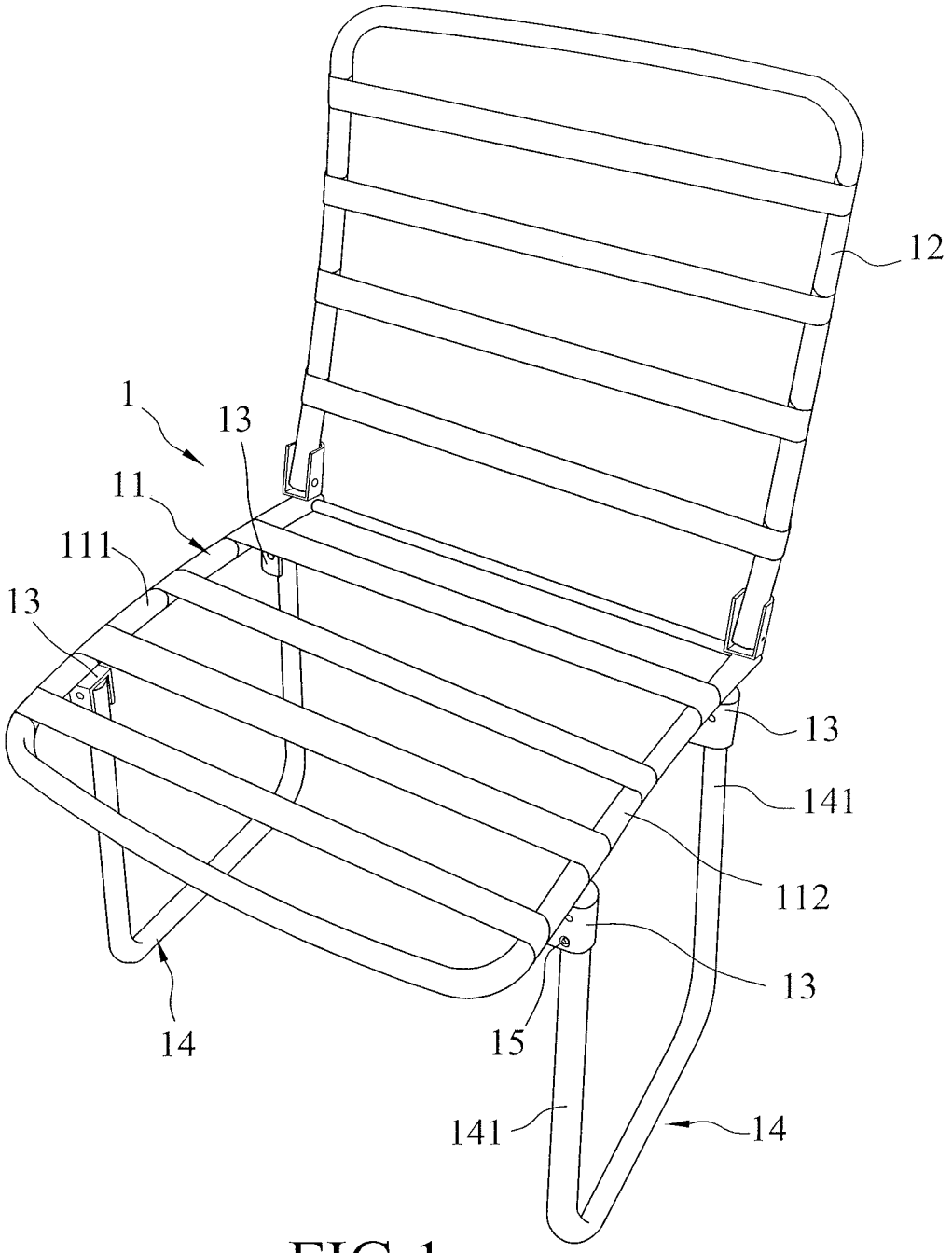
FIG.1 PRIOR ART
FIG. 1 is a perspective view, illustrating a conventional foldable chair in an unfolded use state.
Figure 2:
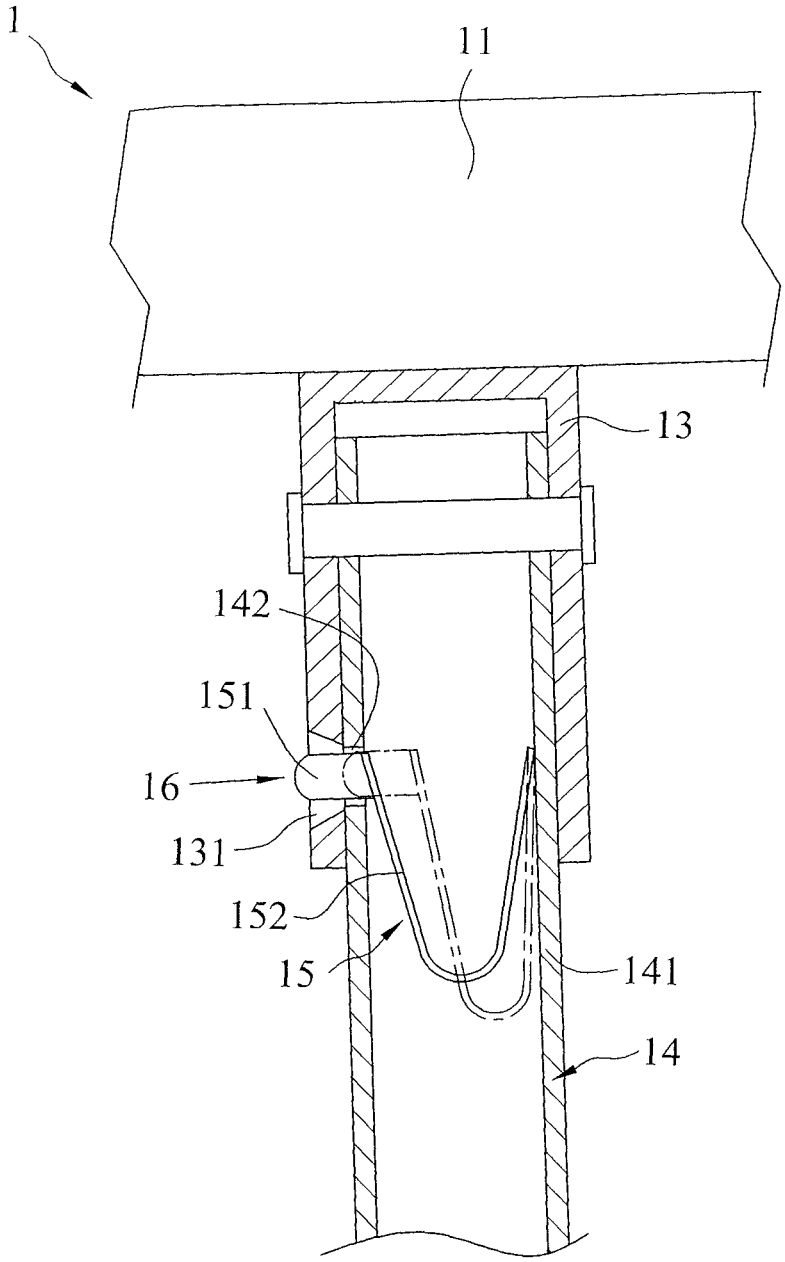
FIG.2 PRIOR ART
FIG. 2 is an enlarged fragmentary schematic sectional view of the conventional foldable chair, illustrating engagement among a resilient fastener, a pivot seat, and a leg frame.

Before the present invention is described in greater detail, it should be noted that like elements are denoted by the same reference numerals throughout the disclosure.

Referring to FIGS. 3 to 6 and 8, the first preferred embodiment of a foldable chair of the present invention is shown to include a seat frame unit 2, a leg frame unit 3, and a leg frame assembling unit 4.

The leg frame unit 3 includes two spaced-apart leg frames 31 that are respectively and pivotally connected to a bottom side of the seat frame unit 2. The leg frame unit 3 is pivotable relative to the seat frame unit 2 to change between an unfolded use state (see FIG. 3) and a folded state (see FIG. 8).

The leg frame assembling unit 4 is provided to assemble the leg frames 31 on the seat frame unit 2, and includes at least one first resilient fastener 41 that is disposed inside one of the leg frames 31, and at least one first pusher 42 that is disposed on the seat frame unit 2 proximate to the first resilient fastener 41. The first resilient fastener 41 has a first locking head 411 that extends through the one of the leg frames 31 and the seat frame unit 2 to immobilize the one of the leg frames 31 in the unfolded use state. The first pusher 42 has a first protruding portion 421 aligned with the first locking head 411. The first pusher 42 is pressable to enable the first protruding portion 421 to push the first locking head 411 such that the first locking head 411 is retracted inwardly from the seat frame unit 2, thereby releasing the one of the leg frames 31 from the unfolded use state relative to the seat frame unit 2.

In this embodiment, the seat frame unit 2 includes a seat frame 21 that is configured in a substantially square shape. The seat frame 21 has spaced-apart left and right seat frame rods 211, 212 and front and rear seat frame rods 213, 214 respectively interconnecting front ends and rear ends of the left and right seat frame rods 211, 212. In addition, the seat frame unit 2 further includes two pairs of first pivot seats 22. Each pair of the first pivot seats 22 is connected to a bottom side of a respective one of the left and right seat frame rods 211, 212 and is pivoted to a respective one of the leg frames 31. Preferably, the seat frame unit 2 further includes two first binding strips 23 that are respectively disposed on the left and right seat frame rods 211, 212, and a seat portion 24 that is disposed between the first binding strips 23. The seat portion 24 has a first string 241 that is passed over the first binding strips 23 and extends back and forth between the first binding strips 23 in a zigzag pattern to allow a user to sit thereon.

The leg frames 31 of the leg frame unit 3 are spaced apart from each other in a left-right direction and are disposed respectively under the left and right seat frame rods 211, 212. Each of the leg frames 31 has two leg frame rods 311 that are spaced apart from each other in a front-rear direction and that are respectively inserted into and connected pivotally to one pair of the first pivot seats 22. In this preferred embodiment, the two leg frame rods 311 of each of the leg frames 31 extend downward from the seat frame unit 2 in the unfolded use state. Preferably, each of the leg frames 31 further has a bottom connecting section 314 that extends in the front-rear direction to interconnect bottom ends of the leg frame rods 311. A front one of the leg frame rods 311 has a front bent section 313 that inclines forwardly and downwardly to the bottom connecting section 314. A rear one of the leg frame rods 311 has a rear bent section 312 that inclines rearward and downwardly to the bottom connecting section 314. In this preferred embodiment, each of the leg frame rods 311 is pivotally riveted to a corresponding one of the first pivot seats 22. However, the present invention is not limited in this respect as long as each leg frame rod 311 and the corresponding one of the first pivot seats 22 are pivotally connected to each other. For example, each leg frame rod 311 may be pivotally connected to the corresponding one of the first pivot seats 22 by nut and bolt fasteners. Moreover, by virtue of a design of the rear bent section 312 that inclines rearwardly and downwardly relative to the bottom connecting section 314, the user may have relatively better support from the foldable chair of the present invention when the user's center of gravity is shifted rearward relative to the seat frame unit 2.

The first resilient fastener 41 of the leg frame assembling unit 4 is disposed inside one of the leg frame rods 311 and has the first locking head 411 that extends through the one of the leg frame rods 311 and a corresponding one of the first pivot seats 22. In this preferred embodiment, the first resilient fastener 41 further has a first elastic strip 412 that is disposed inside the one of the leg frame rods 311. The first elastic strip 412 is a generally V-shaped elastic strip that has two opposite ends. One end of the first elastic strip 412 is fixed on an inner surface of the one of the leg frame rods 311. The other end of the first elastic strip 412 is attached to the first locking head 411. Preferably, the leg frame assembling unit 4 further includes a pivot shaft 43 that extends through and interconnects pivotally the one of the first pivot seats 22 and the one of the leg frame rods 311. The first pusher 42 is made of flexible plastic material. Preferably, the first pusher 42 further has a plate portion 422 that is disposed over an outer surface of the one of the first pivot seats 22 and that has one end attached to the pivot shaft 43 and another end formed with the first protruding portion 421. The one of the leg frame rods 311 and the one of the first pivot seats 22 respectively have locking holes 315, 221 that are aligned with each other for extension of the first locking head 411. The first protruding portion 421 is extendable into the locking hole 221 in the one of the first pivot seats 22 to retract the first locking head 411 into the one of the leg frame rods 311 when the first pusher 42 is pressed. In this preferred embodiment, the number of the pivot shafts 43 is four. The leg frame assembling unit 4 includes four of the first resilient fasteners 41 that are respectively disposed inside the leg frame rods 311 of the leg frames 31, and four of the first pushers 42 that are respectively disposed on the first pivot seats 22.

Preferably, the foldable chair of the present invention further includes a backrest unit 5 and a back frame assembling unit 6 to assemble the backrest unit 5 on the seat frame unit 2. The backrest unit 5 includes a back frame 51 and two spaced-apart left and right second pivot seats 52 that are respectively connected to the left and right seat frame rods 211, 212 of the seat frame unit 2 and that are pivotally connected to the back frame 51. The back frame 51 has two spaced-apart left and right back frame rods 511 that are respectively pivoted to the second pivot seats 52, and a transverse connecting rod 512 that interconnects the left and right back frame rods 511. Preferably, the backrest unit 5 further includes two second binding strips 53 respectively disposed on the back frame rods 511 of the back frame 51, and a backrest portion 54 disposed between the second binding strips 53. The backrest portion 54 has a second string 541 that is passed over the second binding strips 53 and extends back and forth between the second binding strips 53 in a zigzag pattern, thereby allowing the user to lean thereon.

The back frame assembling unit 6 has a structure generally similar to that of the leg frame assembling unit 4. In this preferred embodiment, the back frame assembling unit 6 includes two second resilient fasteners 61 that are respectively disposed inside the left and right back frame rods 511, and two second pushers 62 that are respectively disposed on the second pivot seats 52 proximate to the second resilient fasteners 61.

Each of the second resilient fasteners 61 has a second locking head 611 that extends through one of the left and right back frame rods 511 and one of the second pivot seats 52 to immobilize the one of the left and right back frame rods 511 relative to the seat frame unit 2 in the unfolded use state. In this preferred embodiment, each second resilient fastener 61 further has a second elastic strip 612 that is disposed inside the one of the back frame rods 511. The second elastic strip 612 has one end that is disposed inside the one of the back frame rods 511, and another end that is attached to the second locking head 611. Each of the second pushers 62 has a second protruding portion 621 aligned with the second locking head 611 and is pressable to enable the second protruding portion 621 to push the second locking head 611 such that the second locking head 611 is retracted inwardly from the corresponding one of the second pivot seats 52, thereby permitting the corresponding one of the left and right back frame rods 511 to move relative to the seat frame unit 2. Preferably, each second pusher 62 is made of flexible plastic material and further has a pusher plate portion 622 that is disposed over an outer surface of the one of the second pivot seats 52. The pusher plate portion 622 has an end formed with the second protruding portion 621.

Referring back to FIGS. 3 and 5, when the foldable chair of the present invention is in the unfolded use state, since the first resilient fastener 41 of the leg frame assembling unit 4 is disposed inside the one of the leg frame rods 311 proximate to the one of the first pivot seats 22, the first locking head 411 is able to extend through the locking holes 315, 221 that are respectively formed in the one of the leg frame rods 311 and the one of the first pivot seats 22. Therefore, the first locking head 411 is partly exposed from the outer surface of the one of the first pivot seats 22 and abuts against the corresponding first pusher 42. Likewise, the second locking head 611 of the back frame assembling unit 6 is partly exposed from the outer surface of the one of the second pivot seats 52 and abuts against the corresponding second pusher 62.

Figure 5:
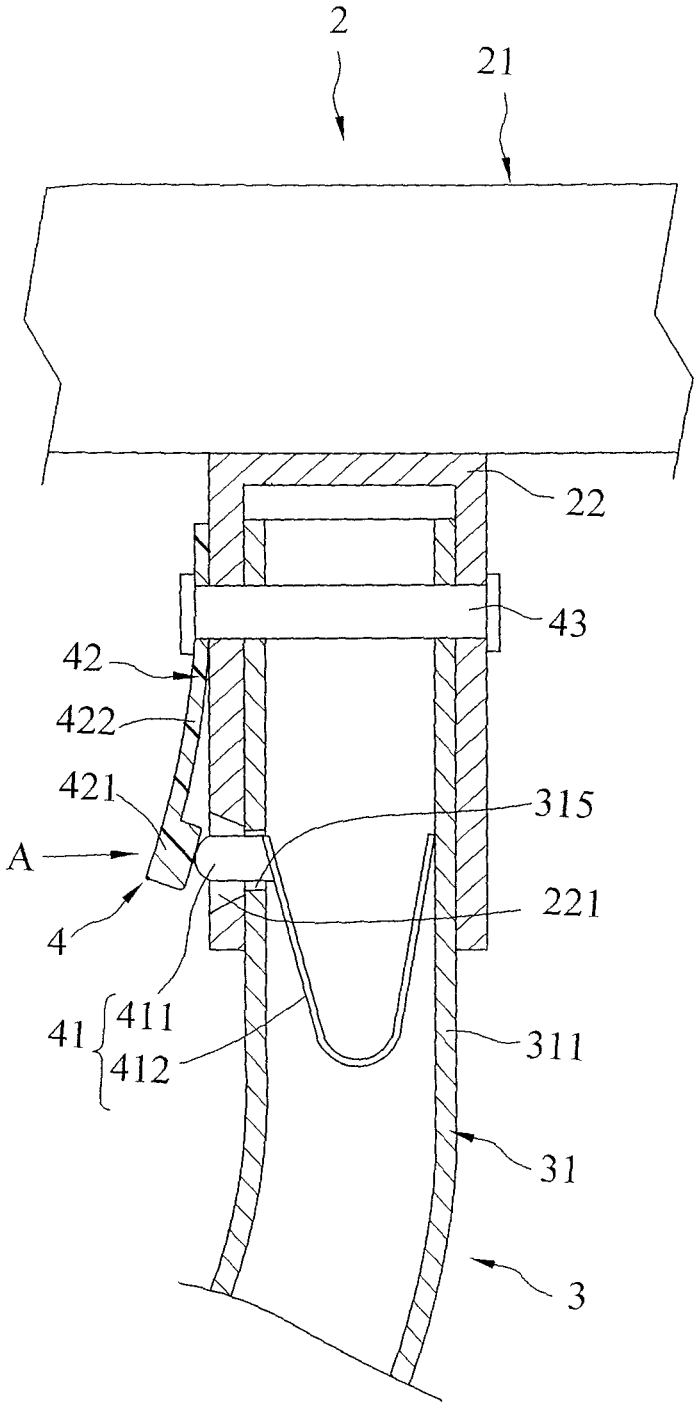
FIG. 5 is an enlarged fragmentary schematic sectional view of the first preferred embodiment, illustrating a first pusher proximate to a first resilient fastener.
Figure 6:
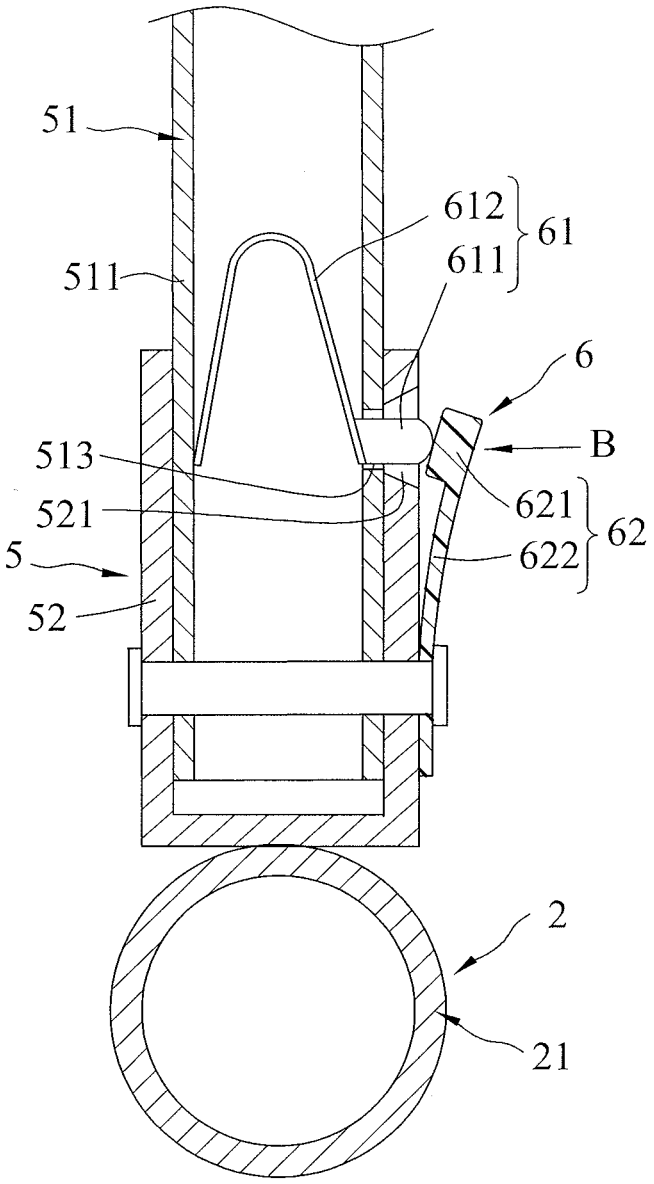
FIG. 6 is an enlarged fragmentary schematic sectional view of the first preferred embodiment, illustrating a second pusher proximate to a second resilient fastener.
Figure 7:
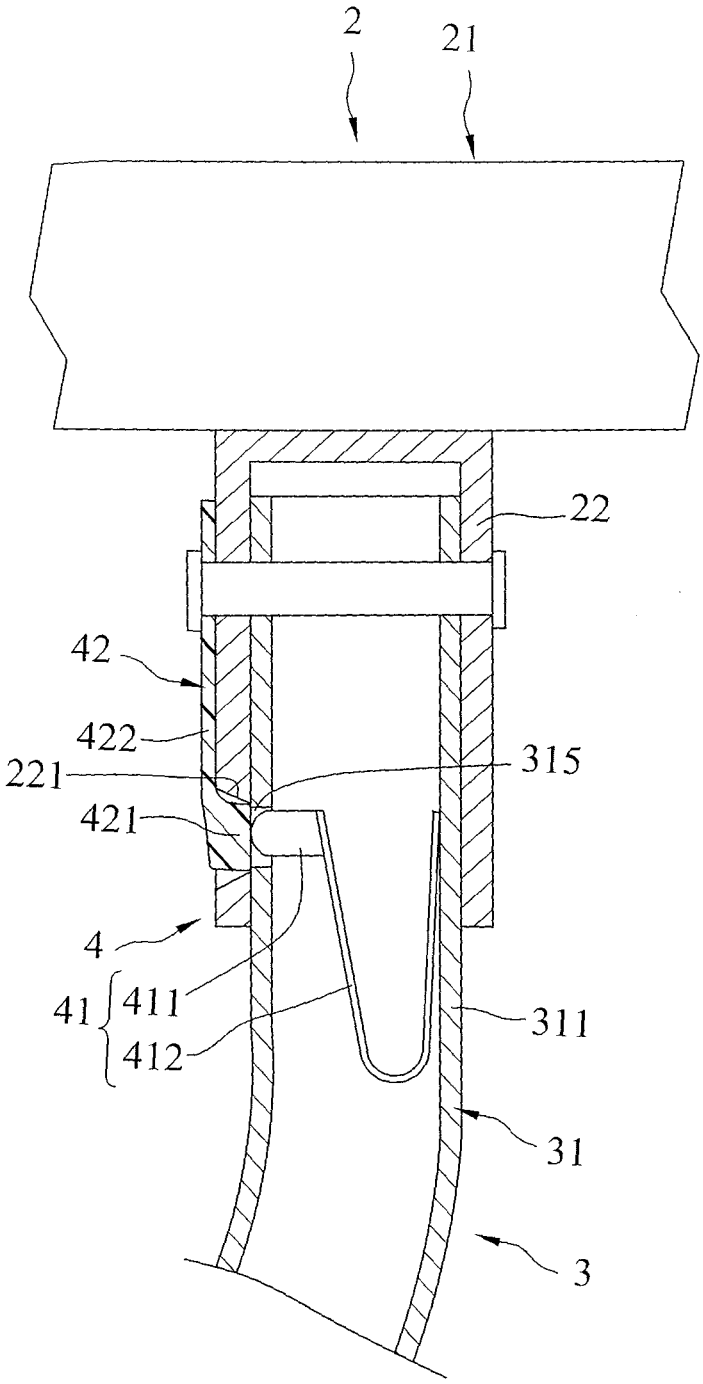
FIG. 7 is a partly sectional view of the first embodiment, illustrating the first pusher to push the first resilient fastener in a leg frame.
Figure 8:
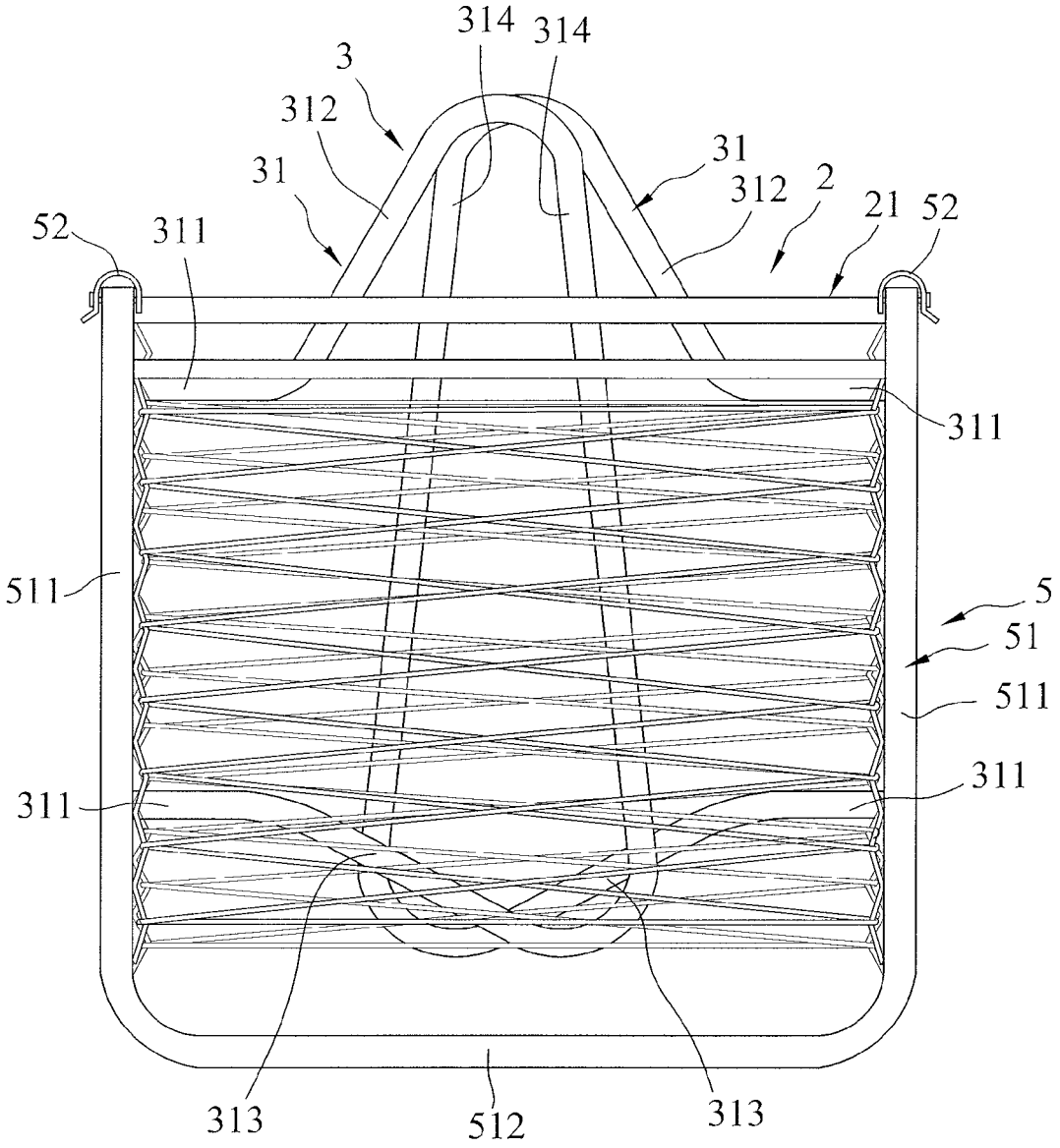
FIG. 8 is a top view, illustrating the first preferred embodiment in a folded state.

Referring back to FIGS. 5, 6 and 8 in combination with FIG. 7, when the foldable chair of the present invention is required to be in the folded state, the leg frames 31 are first to be folded relative to the seat frame unit 2. Since each of the leg frames 31 is folded in a similar way, only one of the leg frames 31 will be exemplified hereinafter. As shown in FIG. 5, when the user presses the first pusher 42 over the first pivot seat 22 in a direction of an arrow (A), the first protruding portion 421 is enabled to push the first locking head 411. As shown in FIG. 7, the first locking head 411 is being retracted inwardly in the leg frame rod 311, such that the first elastic strip 412 is forcedly deformed. Until the first locking head 411 is disengaged from the locking hole 221 of the first pivot seat 22, the leg frame 31 is released from the first pivot seat 22. As a result, as shown in FIG. 8, the leg frames 31 of the foldable chair of the present invention may be folded toward each other and beneath the seat frame 21. Analogously, when the backrest unit 5 is required to be folded over the seat frame unit 2, the user presses the second pusher 62 over the second pivot seat 52 in a direction of an arrow (B) as shown in FIG. 6. The second protruding portion 621 is enabled to push the second locking head 611, such that the second locking head 611 is disengaged from the second pivot seat 52. Hence, the back frame 51 is released from the seat frame 21. As a result, the back frame 51 may be pivotally folded over the seat frame 21 as shown in FIG. 8.

Specifically, when the leg frame unit 3 is in the folded state, the rear bent sections 312 of the leg frames 31 overlap each other to form a holding region. By virtue of the holding region, the user is able to hold the bent sections 312 and then lift the foldable chair of the present invention for transport.

Figure 3:
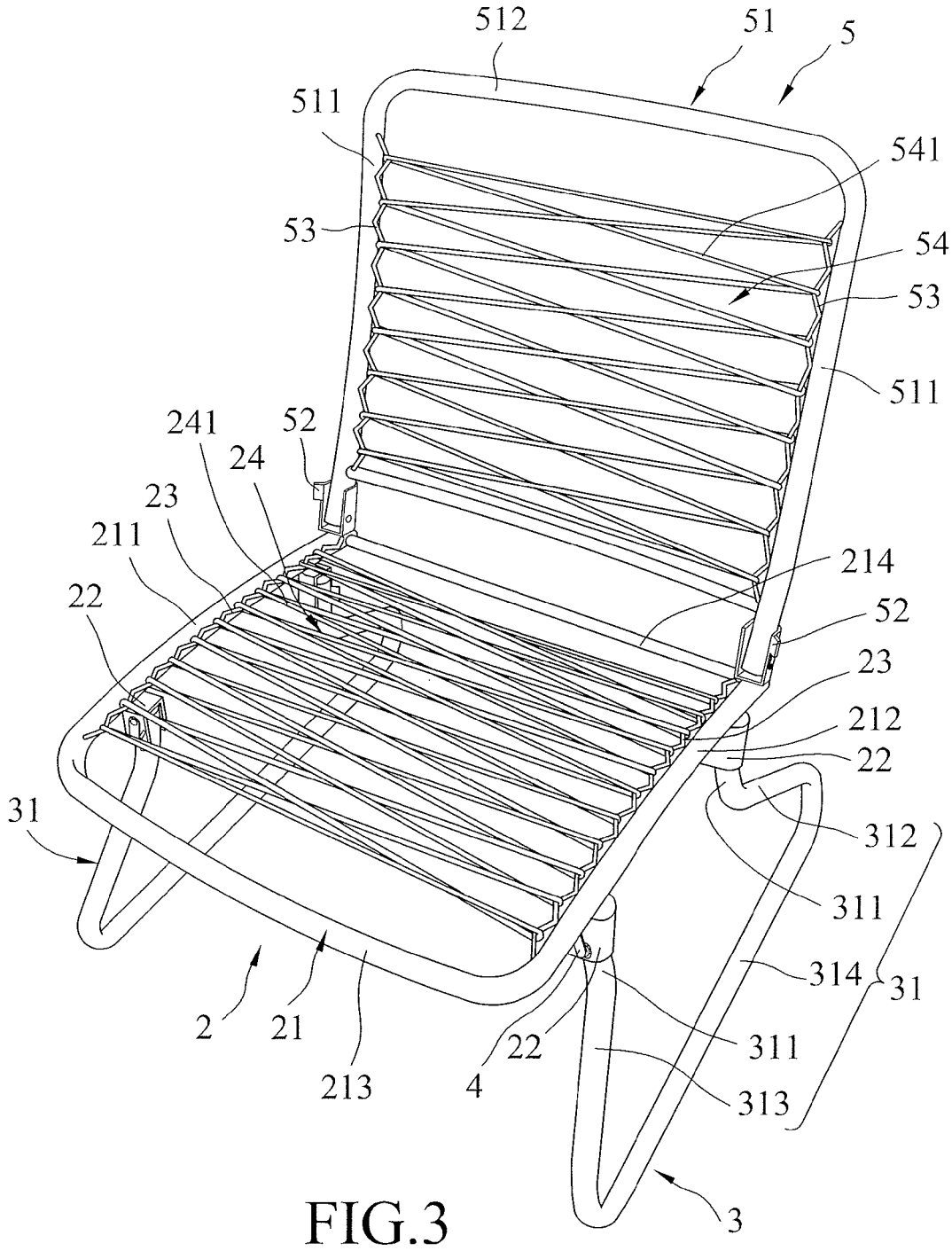
FIG. 3 is a perspective view, illustrating the first preferred embodiment of a foldable chair according to the present invention in an unfolded use state.
Figure 4:
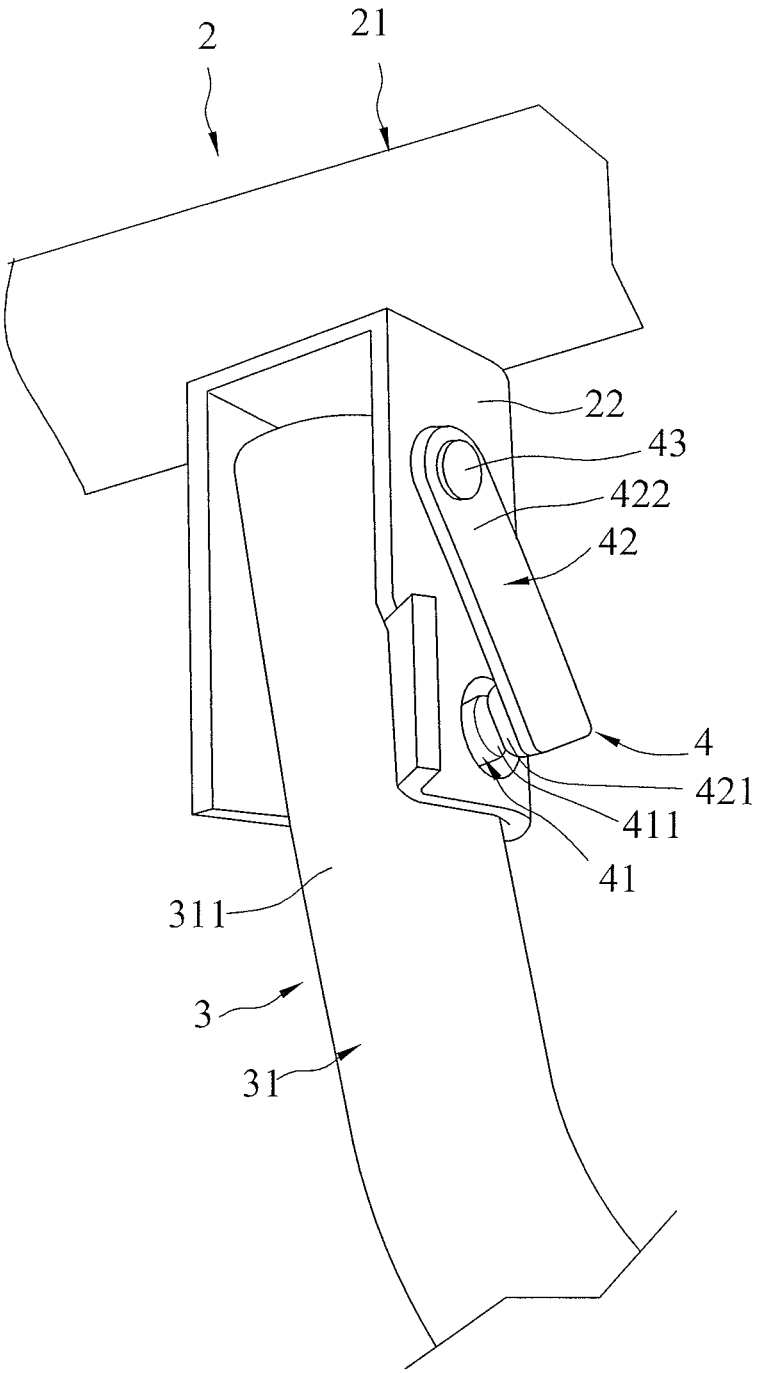
FIG. 4 is an enlarged fragmentary perspective view of the first preferred embodiment.

When the foldable chair of the present invention is required to be in the unfolded use state, the user just needs to hold and lift the transverse connecting rod 512 of the back frame 51 such that the back frame 51 is pivoted relative to the seat frame unit 2. Until the second locking heads 611 of the second resilient fasteners 61 extend through the back frame rods 511 and the second pivot seats 52, the back frame rods 511 respectively abut against inner surfaces of the second pivot seats 52 and are immobilized relative to the seat frame unit 2. When the foldable chair is lifted to let the leg frames 31 leave the ground, the leg frames 31 tend to extend downwardly due to their own weights. Eventually, as shown in FIG. 3, the leg frame unit 3 is pivoted relative to the seat frame unit 2 to the unfolded use state. It should be noted that, although the second locking head 611 of the second resilient fastener 62 is in the form of a protrusion that protrudes out of the back frame rod 511, such a configuration of the protrusion does not impede insertion of the second locking head 611 between the back frame rod 511 and the second pivot seat 52 when the back frame 51 is pivoted relative to the seat frame unit 2. Since the second locking head 611 is designed to have a circular outer surface, during lifting of the back frame 51, the second locking head 611 is pressed and retracted inwardly to the back frame rod 511 by an inner surface of the second pivot seat 52, such that the back frame rod 511 is pivotally movable relative to the second pivot seat 52. Until the second locking head 611 is proximate to locking holes 513, 521 (see FIG. 6) of the back frame rod 511 and the second pivot seat 52, and extends through the back frame rod 511 and the second pivot seat 52, the back frame 51 is immobilized relative to the seat frame unit 2 in the unfolded use state. Likewise, when the leg frame 31 is unfolded, the first locking head 411 and the first pivot seat 22 cooperate to have an engagement effect similar to that between the second locking head 611 and the second pivot seat 52.

In an alternative embodiment, the leg frame assembling unit 4 may include only one first resilient fastener 41 disposed inside one of the leg frame rods 311, and only one first pusher 42 disposed on the corresponding first pivot seat 22 to achieve the object of the foldable chair of the present invention. Moreover, in actual implementation, the backrest unit 5 and the back frame assembling unit 6 may be omitted.

Figure 9:
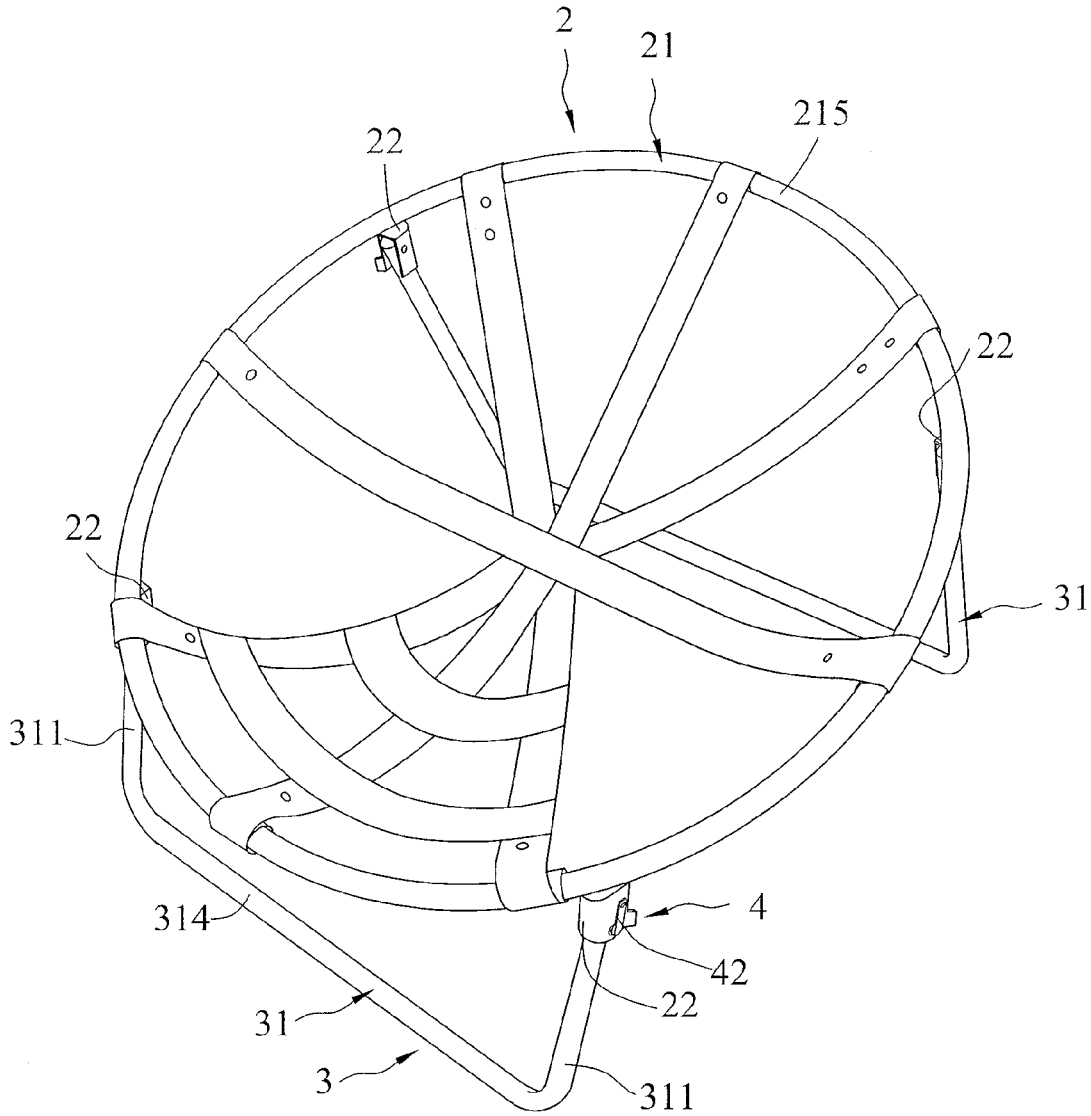
FIG. 9 is a perspective view, illustrating the second preferred embodiment of a foldable chair according to the present invention in the unfolded use state.

FIG. 9 shows the second preferred embodiment of a foldable chair according to the present invention, which has a structure generally similar to that of the first embodiment except for the structures of the seat frame 21 of the seat frame unit 2 and the leg frame 31 of the leg frame unit 3.

The seat frame 21 of the seat frame unit 2 includes a ring frame rod 215. The seat frame unit 2 further includes two pairs of first pivot seats 22. The first pivot seats 22 in each pair are spaced apart from each other in the front-rear direction and are connected to a bottom side of the ring frame rod 215 to be pivoted to a respective one of the leg frames 31. The leg frames 31 are spaced apart in the front-rear direction. Each of the leg frames 31 has two spaced-apart left and right leg frame rods 311 that are respectively pivoted to two of the first pivot seats 22 that are spaced apart in the left-right direction. The leg frame assembling unit 4 has four of the first resilient fasteners 41 (see FIG. 5) each of which has the first fastening head 411 extending through a corresponding one of the leg frame rods 311 and a corresponding one of the first pivot seats 22. Preferably, the leg frame assembling unit 4 has four first pushers 42 that are respectively disposed on the pairs of the first pivot seats 22 and proximate to the first resilient fasteners 41. Each of the leg frames 31 further has a bottom connecting section 314 that extends in the left-right direction to interconnect bottom ends of the leg frame rods 311. Since the leg frames 31 are foldable relative to each other in a way similar to that of the first preferred embodiment, details of the folding operation are omitted herein for the sake of brevity.

To sum up, by virtue of a design that the first pusher 42 is proximate to the first resilient fastener 41, the user is able to press the first pusher 42 with convenience and safety, such that the first protruding portion 421 abuts against and retracts the first locking head 411. As a result, the leg frames 31 are released from the unfolded use state relative to the seat frame 21. Therefore, the foldable chair of the present invention is able to prevent the user from cutting his or her fingers during the folding operation.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A foldable chair comprising:

a seat frame unit (2);

a leg frame unit (3) including two spaced-apart leg frames (31) respectively and pivotally connected to a bottom side of said seat frame unit (2), said leg frame unit (3) being pivotable relative to said seat frame unit (2) to change between an unfolded use state and a folded state; and a leg frame assembling unit (4) to assemble said leg frames (31) on said seat frame unit (2), and including at least one first resilient fastener (41) disposed inside one of said leg frames (31), and at least one first pusher (42) disposed on said seat frame unit (2) proximate to said first resilient fastener (41), said first resilient fastener (41) having a first locking head (411) that extends through said one of said leg frames (31) and said seat frame unit (2) to immobilize said one of said leg frames (31) in said unfolded use state, said first pusher (42) having a first protruding portion (421) aligned with said first locking head (411), said first pusher (42) being pressable to enable said first protruding portion (421) to push said first locking head (411) such that said first locking head (411) is retracted inwardly from said seat frame unit (2), thereby releasing said one of said leg frames (31) from said unfolded use state relative to said seat frame unit (2);

wherein said seat frame unit (2) includes a seat frame (21), said seat frame (21) having spaced-apart left and right seat frame rods (211, 212) and front and rear seat frame rods (213, 214) respectively interconnecting front ends and rear ends of said left and right seat frame rods (211, 212), said seat frame unit (2) further including two pairs of first pivot seats (22), each pair of said first pivot seats (22) being connected to a bottom side of a respective one of said left and right seat frame rods (211, 212) and being pivoted to a respective one of said leg frames (31), said leg frames (31) being spaced apart from each other in a left-right direction, each of said leg frames (31) having two leg frame rods (311) that are spaced apart from each other in a front-rear direction and that are respectively inserted into and connected pivotally to one pair of said first pivot seats (22), said first resilient fastener (41) being disposed inside one of said leg frame rods (311) and having said first locking head (411) extending through said one of said leg frame rods (311) and a corresponding one of said first pivot seats (22); and wherein said leg frame assembling unit (4) further includes a pivot shaft (43) that extends through and interconnects pivotally said one of said first pivot seats (22) and said one of said leg frame rods (311), said first pusher (42) further having a plate portion (422) that is disposed over an outer surface of said one of said first pivot seats (22) and that has one end attached to said pivot shaft (43) and another end formed with said first protruding portion (421), and one of said leg frame rods (311) and said one of said first pivot seats (22) respectively having locking holes (315, 221) that are aligned with each other for extension of said first locking head (411), said first protruding portion (421) being extendable into said locking hole (221) in said one of said first pivot seats (22) to retract said first locking head (411) into said one of said leg frame rods (311) when said first pusher (42) is pressed.

2. The foldable chair as claimed in claim 1, wherein said leg frame assembling unit includes four of said first resilient fasteners respectively disposed inside said leg frame rods of said leg frames, and four of said first pushers respectively disposed on said first pivot seats.

* * * * *